United States Patent [19]

Mueller

[11] Patent Number: 4,712,816

[45] Date of Patent: Dec. 15, 1987

[54] AUXILIARY DOOR LATCH FOR CHILDREN'S SAFETY

[76] Inventor: Theodore V. Mueller, 760 Preakness La., Florissant, Mo. 63033

[21] Appl. No.: 861,980

[22] Filed: May 12, 1986

[51] Int. Cl.[4] ..... E05C 19/18; E05C 3/04

[52] U.S. Cl. ..... 292/253; 292/262; 292/288

[58] Field of Search ..... 292/262, 253, 246, 258, 292/288, 289, 343; 24/141, 697

[56] References Cited

U.S. PATENT DOCUMENTS

| | | | |
|---|---|---|---|
| 369,185 | 8/1887 | Ketchum | 292/246 |
| 654,723 | 7/1900 | Franks | 292/262 |
| 848,644 | 4/1907 | Flegel | 292/288 |
| 1,719,343 | 7/1929 | Strayer | 292/288 |
| 1,891,065 | 12/1932 | Sitton | 24/141 |
| 2,199,369 | 4/1940 | Bernstein | 292/262 |
| 2,374,426 | 4/1945 | Diederich | 292/262 |
| 2,918,318 | 12/1959 | Sacharski | 292/288 |
| 3,124,381 | 3/1964 | Geldart | 292/288 |
| 3,309,126 | 3/1967 | Schuette | 292/87 |
| 3,831,987 | 8/1974 | Misenheimer | 292/262 |
| 3,836,187 | 9/1974 | Buettner | 292/262 |
| 4,191,413 | 3/1980 | Barner | 292/262 |
| 4,288,119 | 9/1981 | Geiger | 292/262 |
| 4,469,358 | 9/1984 | Abbott | 292/288 |
| 4,575,140 | 3/1986 | Dargis | 292/289 |

FOREIGN PATENT DOCUMENTS

| | | | |
|---|---|---|---|
| 5355 | of 1882 | United Kingdom | 24/697 |
| 7063 | of 1897 | United Kingdom | 24/697 |
| 2131866 | 6/1984 | United Kingdom | 292/288 |

*Primary Examiner*—William F. Pate, III
*Assistant Examiner*—Michael Safavi
*Attorney, Agent, or Firm*—Kalish & Gilster

[57] ABSTRACT

An auxiliary door latch for children's safety which comprises a flexible tape-like member having openings in opposite end portions for detachably engaging projecting heads provided on the free end portion of a door and the adjacent jamb. The flexibility of the tape-like member permits reliable and facile accommodation for the particular locations of said heads, which latter may, if desired, be readily removed in periods of disuse.

1 Claim, 4 Drawing Figures

AUXILIARY DOOR LATCH FOR CHILDREN'S SAFETY

BACKGROUND AND SUMMARY OF THE INVENTION

This invention relates in general to door fastening means and, more particularly, to an auxiliary portable latch for preventing unauthorized door opening by children.

Heretofore, various efforts have been undertaken for providing a fastener to be utilized with primarily doors and sometimes windows in addition to the provided locks or latches for preventing the opening of the door or window as the case may be by a child who may have previously determined the appropriate operation of the provided latch or lock. Such prior attempts are exemplified by U.S. Pat. No. 2,128,479, which comprehends a complex member developed as of spring steel and incorporating interacting elements as well as being designed for permanent adherence to one of the door components. The Andreas U.S. Pat. No. 1,516,692 also shows a door fastener comprising a pair of coacting intricately constructed elements for rigid adherence to the door and adjacent jamb. The child-proof latch of the Hillman patent is a very complex device containing a multiplicity of components which are integrated into the door structure. Other attempts to solve the problem of inhibiting improper entry into a room by a child are shown in the Wilzig et al U.S. Pat. No. 4,159,838; Reidhaar U.S. Pat. No. 1,773,751 and the Schuette U.S. Pat. No. 3,309,126. A careful review of these last-mentioned patents will disclose the fundamental objection to all current expedients for rendering doors child-proof and that is the complexity of the individual constituents of the systems used and the necessity of affixing same in a manner which requires all too often modification of the door components.

Therefore, it is an object of the present invention to provide an auxiliary door locking device which may be easily applied to existing door constructions without necessitating any fundamental modification thereof.

It is another object of the present invention to provide an auxiliary door locking device which is of a detachable character so that it may be optionally applied to a particular door when desired and thus not remain a permanent component thereof.

It is another object of the present invention to provide a door locking device of the character stated which can be applied to the door and related structure in a preselected manner for facile compatibility with the structure involved.

It is a still further object of the present invention to provide an auxiliary door lock of the character stated which embodies a flexible fastener produced in a most economical fashion so that the replacement of the same through inadvertent loss or otherwise is readily achieved.

It is still another object of the present invention to provide an auxiliary door lock of the character stated which is entirely reliable in usage; which may be affixed in operative position by the average unskilled individual; which is durable in usage; and which is reliably effective.

DESCRIPTION OF THE PRACTICAL EMBODIMENTS

Figure 1:
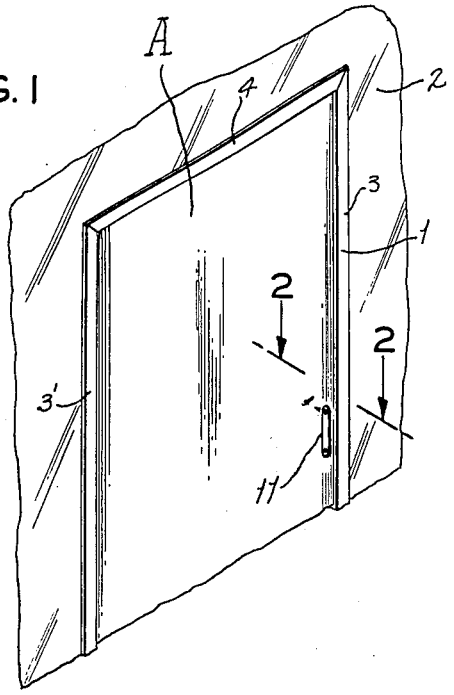
FIG. 1 is a fragmentary perspective view of a door construction supplied with an auxiliary door lock constructed in accordance with and embodying the present invention.
Figure 3:
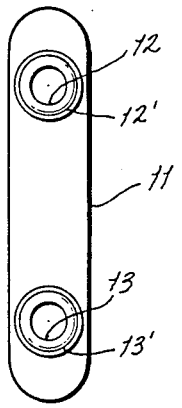
FIG. 3 is a front view of the tape fastener.

Referring now by reference characters to the drawings which illustrate practical embodiments of the present invention, A designates a conventional interior door set within a frame 1 for normal swingable movement, said frame being appropriately located within a wall 2. Said frame 1 comprises the usual side members 3, 3' and header 4, said side members centrally incorporating the usual projecting jamb stop 5 with the customary shoulders 6, 6' for abutment of the former against the rearward edge portion 7 of the rear face 8 of door A for restricting swinging thereof for normally closed condition. Door A thus also comprehends the usual free outer end face 9 and a forward face 10. It is understood that the hinge (not shown) is engaged on the opposite end portion of door A.

In addition to the normal latch arrangement for door A and the associated side member 3 (not shown), there is provided an auxiliary door locking device 11 which is of elongated strip-like character being fabricated of any durable flexible material whether synthetic, natural, or combinations thereof and being relatively thin for interjection between door A and the immediate confronting portions of side member 3 when door A is in closed condition. Thus device 11 is, in fact, of a tape-like nature and in its opposed end portions is provided with openings 12, 13 each of which is preferably edgewise reinforced by a grommet 12', 13', respectively.

Threaded or otherwise engaged within jamb stop 5, preferably centrally thereof, is a fastener 14 which may be a screw and having its head 15 projecting a short distance beyond the face of jamb stop 5 for accomodating the thickness of the grommets 12', 13' on device 11. Thus, head 15 is dimensioned for extension through opening 12 of tape 11 so as to maintain the adjacent portion thereof against the confronting face of jamb stop 5. Similarly, affixed on door A for projection outwardly from the forward face 10 thereof is a similar fastener 16 having the head thereof 17 projecting spacedly from the outer surface of door A for accomodating therebetween grommet 12' of tape 11.

From the foregoing the purpose and utilization of device 11 should become quite apparent. The grommet 12' is slipped over the head 17 of fastener 16 and then said tape 11 is suitably manipulated for extension over door end face 9, and thence beyond shoulder 6 for presenting the other grommet about the head adjacent portion of fastener 14 so that the head 15 will extend through opening 12.

Thus by reason of the flexibility of device 11, it quite simply effects the requisite bending occasioned by the relationship of door A to jamb stop 5 with a section obviously extending between the said door portion 7 and the jamb stop shoulder 6.

From the foregoing, door A is held against swinging movement away from jamb stop 5 by reason of the interconnection occasioned by the use of device 11.

Consequently, any child attempting to effect opening of door A through the customary manipulation of the handle will be frustrated since device 11 will assure of retention of door A in closed condition with respect to jamb stop 6.

The device 11 may be very easily removed from operative position by simply pulling the device 11 over the head 15 of fastener 14. The device 11 may be allowed to remain in suspended condition from fastener 16 if desired pending further utilization or, in the alternative, may be removed in its entirety by simply effecting relative withdrawal of head 17 through device opening 13.

The material of construction of device 11 is quite cheap so that the misplacement of the same will occasion no serious econimic hardship and from the foregoing disposition of the same into, and removal from, operative position does not require any developed skills.

Figure 2:
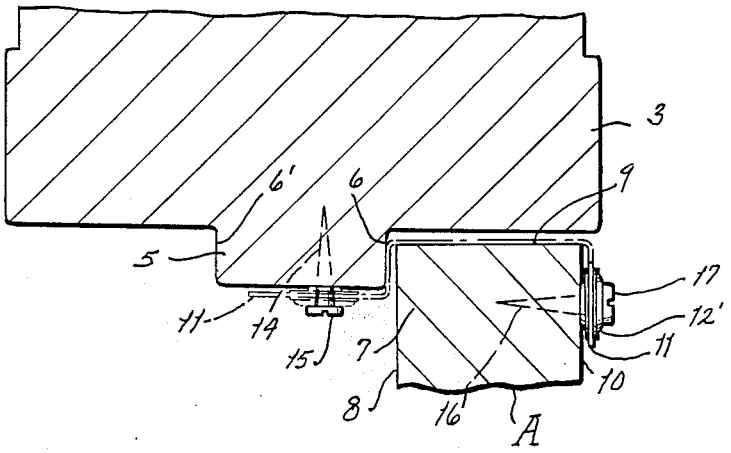
FIG. 2 is a horizontal transverse sectional view taken on the line 2—2 of FIG. 1.
Figure 4:
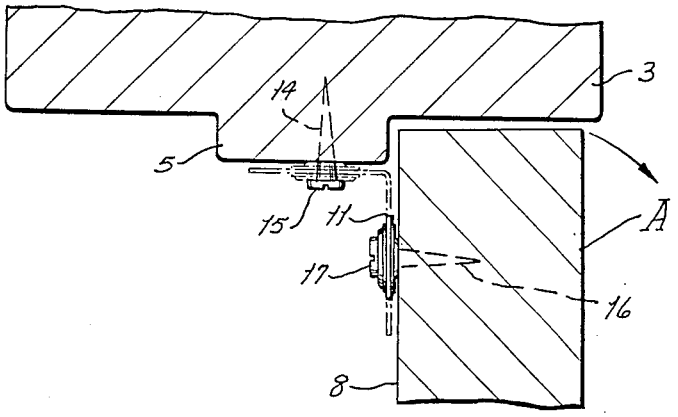
FIG. 4 is a transverse sectional view taken substantially on the line 2—2 of FIG. 1 illustrating another arrangement for the lock.

Referring now to FIG. 4, another form of locking device arrangement is disclosed and therein like elements and components as shown in FIG. 2 will bear the same reference numeral or letter as the case may be. Thus, in the embodiment illustrated in FIG. 4, it will be seen that fastener 16 is engaged to door A so that the head 17 thereof projects from the rearward face 8 of door A. Accordingly, by means of locking device 11, door A is engaged to jamb stop 5 by virtue of extending parallel to the inward face of said jamb stop 5 and thence in an axially perpendicular direction across rear face 8 of door A to present the grommeted opening 13 embracingly about said fastener head 17. Accordingly, by this arrangement, device 11 through its inherent flexibility accomplishes its safety-lock purpose by engagement between the jamb stop and the adjacent, inner face of the door A as distinguished from interconnecting the jamb stop and the door outer face.

Therefore, in view of the foregoing, it is quite apparent that the present invention provides a most utilitarian and novel means for providing an auxiliary door lock. The device 11 is most economically produced and is easily disposed in operative position or removed therefrom; while being totally effective for the intended purpose when suitably engaged in door-closing disposition.

What is claimed is:

1. In combination with a door and a frame therefor, said frame having first and second opposed jambs and a header defining a door opening, said opposed jambs and header having outer and inner sides, said door having an outer face, an inner face, and first and second opposed side edges, means swingably mounting said second side edge of said door to said second jamb for optional opening and closing action of said door with respect to said door opening, said door being free on the first side edge thereof and with said first side edge being presented confrontingly toward said first jamb when said door is in a closed condition, said frame further having a jamb stop provided on said first jamb, said jamb stop having a central portion projecting into said door opening and an outer and an inner shoulder, said outer shoulder being presented a distance from the outer side of said first jamb for receiving the door therebetween when closed whereby the inner face of said door approximate the free edge thereof will be in confronting relationship with the door stop outer shoulder, an auxiliary door latch for maintaining said door in closed condition for assuring security comprising a first mounting member secured upon said jamb stop between said outer and inner shoulders and having a head projecting spacedly from said jamb stop into said door opening, a second mounting member secured upon and projecting outwardly of said outer face of said door proximate the free side edge thereof, and an independent latching element detachably interengaging said first and second mounting members for securing said door against accidental opening comprising an elongated, narrow, thin, flat, tape-like, latching element being free at opposite ends thereof and fabricated of flexible, durable material said latching element conforming to the contouring developed by the outer face of said door, the free side edge of said door, the outer shoulder of the jamb stop, and the central portion of said jamb stop when the door is in closed condition, said latching element being in a non-interfering disposition between the jamb and the door free edge and the jamb stop outer shoulder and door inner face, said latching element having an opening provided adjacent, but spacedly from, each end thereof, said latching element openings being of predetermined cross section with the heads of said first and second mounting members projecting therethrough placing said latching element in an operative condition.

* * * * *